US008162075B2

(12) United States Patent
Roberts et al.

(10) Patent No.: US 8,162,075 B2
(45) Date of Patent: Apr. 24, 2012

(54) VIBRATION DAMPENING MECHANISM FOR POWER TOOL

(75) Inventors: Ana-Marie Roberts, Huenstetten-Wallrabenstein (DE); Norbert Hahn, Huenstetten-Limbach (DE); Ralf Seebauer, Murrhardt (DE)

(73) Assignee: Black & Decker Inc., Newark, DE (US)

( * ) Notice: Subject to any disclaimer, the term of this patent is extended or adjusted under 35 U.S.C. 154(b) by 574 days.

(21) Appl. No.: 12/179,840

(22) Filed: Jul. 25, 2008

(65) Prior Publication Data

US 2009/0049651 A1 Feb. 26, 2009

(30) Foreign Application Priority Data

Jul. 27, 2007 (GB) ..... 0714705.1

(51) Int. Cl.
*B25D 17/24* (2006.01)
*B25D 17/28* (2006.01)

(52) U.S. Cl. ..... 173/162.2; 173/162.1

(58) Field of Classification Search ..... 173/162.1, 173/162.2, 170; 30/381; 16/431
See application file for complete search history.

(56) References Cited

U.S. PATENT DOCUMENTS

| | | | | |
|---|---|---|---|---|
| 3,322,211 | A * | 5/1967 | Alabuzhev et al. | 173/162.2 |
| 4,711,308 | A | 12/1987 | Blaas et al. | |
| 2003/0132016 | A1 * | 7/2003 | Meixner et al. | 173/162.2 |
| 2004/0040729 | A1 * | 3/2004 | Meixner | 173/162.2 |
| 2006/0011365 | A1 * | 1/2006 | Stirm et al. | 173/162.2 |
| 2008/0283261 | A1 * | 11/2008 | Schmid et al. | 173/162.2 |
| 2009/0272553 | A1 * | 11/2009 | Engelfried et al. | 173/162.2 |

FOREIGN PATENT DOCUMENTS

| | | |
|---|---|---|
| DE | 102006016442 | 10/2007 |
| DE | 102006021307 | 11/2007 |
| EP | 1157788 | 11/2001 |
| EP | 1529603 | 5/2005 |
| GB | 112786 | 1/1918 |
| WO | 02083369 | 10/2002 |
| WO | 2008055739 | 5/2008 |

* cited by examiner

*Primary Examiner* — Rinaldi Rada
*Assistant Examiner* — Nathaniel Chukwurah
(74) *Attorney, Agent, or Firm* — Kofi Schulterbrandt; Scott B. Markow; Adan Ayala

(57) ABSTRACT

A powered hammer includes a body in which is disposed a motor and a hammer mechanism driven by the motor when the motor is activated. A tool holder is coupled to a front portion of the body and which is capable of holding a cutting tool. The hammer mechanism, when driven by the motor, is capable of imparting impacts to a cutting tool, when held by the tool holder. A handle is moveably coupled to a rear portion of the body for movement toward and away from the body along a tool axis of the tool holder. The handle includes a grip portion and first and second end connection sections coupled to opposite end portions of the grip portion. The first and second end connection sections are slideably mounted on first and second arms that project rearward from the body. A movement control mechanism is mounted inside the handle and coupled to the first and second arms and the handle. The movement control mechanism is configured to ensure that the two end connection sections move toward and away from the body in unison to inhibit angular movement of the grip portion relative to the body. A damping element disposed between the handle and the body to reduce vibration transferred from the body to the rear handle.

19 Claims, 6 Drawing Sheets

VIBRATION DAMPENING MECHANISM FOR POWER TOOL

CROSS REFERENCE TO RELATED APPLICATIONS

This application claims priority, under 35 U.S.C. §119, to UK Patent Application No. GB 07 147 05.1, filed Jul. 27, 2007, titled "Hammer Handle," which is incorporated herein by reference in its entirety.

TECHNICAL FIELD

This application relates to relates to a vibration dampening mechanism for a handle of a power tool such as powered hammer or hammer drill.

BACKGROUND

A typical powered hammer or hammer drill, such as the one disclosed in EP1157788, may include a body in which is mounted an electric motor and a hammer mechanism. A tool holder may be mounted on the front of the body which holds a cutting tool, such as a drill bit or a chisel. The hammer mechanism may include a slideable ram reciprocatingly driven by a piston, the piston being reciprocatingly driven by the motor via a set of gears and a crank mechanism or wobble bearing. The ram may repeatedly strike the end of the cutting tool via a beat piece. When the only action on the tool bit is the repetitive striking of its end by the beat piece, the hammer drill is operating in a hammer only mode.

Certain types of hammer drills also comprise a rotary drive mechanism which enable the tool holder to rotatingly drive the cutting tool held within the tool holder. This can be in addition to the repetitive striking of the end of the cutting tool by the beat piece (in which case, the hammer drill is operating in a hammer and drill mode) and/or as an alternative to the repetitive striking of the end of the cutting tool by the beat piece (in which case, the hammer drill is operating in a drill only mode).

Hammer drills are supported by the operator using one or more handles. In one example of a hammer drill, there is a rear handle attached to the rear of the body of the hammer drill, at the opposite end of the body to where the tool holder is mounted. The operator pushes the cutting tool into a work piece by pushing the rear handle towards the body, which in turn pushes the body and the cutting tool towards the work piece.

Hammer drills tend to generate vibration, in particular, by operation of the hammer mechanism. This vibration is transferred to the hands of the operator holding the handles of the hammer drill, particularly through the rear handle. This can result in the injury of the hands of the operator. As such, it is desirable to minimize the effect of vibration experienced by the hands of the operator. This is achieved by reducing the amount by which the handle vibrates. One method is to reduce the amount of vibration produced by the whole hammer drill. Another method is to reduce the amount of vibration transferred from the body of the hammer drill to the rear handle. For example, EP 1529603 discloses a dampening mechanism for a rear handle by which the amount of vibration transferred from the body to the handle is reduced.

SUMMARY

In an aspect, a hammer drill includes a body in which is mounted a motor and a hammer mechanism; the hammer mechanism being driven by the motor when the motor is activated; a tool holder mounted on the front of the body and which is capable of holding a cutting tool, the hammer mechanism, when driven by the motor, capable of imparting impacts to a cutting tool, when held by the tool holder; a rear handle, moveably connected to the rear of the body and which is capable of moving towards or away from the body; wherein the rear handle comprises a centre grip section and two end connection sections one end connection section being attached to one end of the centre grip section, the other end connection section being connected to the other end of the centre grip section 90 each end connection section being slideably mounted on an arm which projects rearward from the body so that they can slide along the arms towards or away from the body; a movement control mechanism which controls the movement of the handle relative to the body; and a dampening mechanism which reduces the vibration transferred from the body to the rear handle. The movement control mechanism is mounted inside the rear handle and connects between the arms and the handle and which ensures that the two end connection sections move towards or away from the body in unison to prevent angular movement of the centre grip section relative to the body.

In another aspect, a powered hammer includes a body in which is disposed a motor and a hammer mechanism driven by the motor when the motor is activated. A tool holder is coupled to a front portion of the body and which is capable of holding a cutting tool. The hammer mechanism, when driven by the motor, is capable of imparting impacts to a cutting tool, when held by the tool holder. A handle is moveably coupled to a rear portion of the body for movement toward and away from the body along a tool axis of the tool holder. The handle includes a grip portion and first and second end connection sections coupled to opposite end portions of the grip portion. The first and second end connection sections are slideably mounted on first and second arms that project rearward from the body. A movement control mechanism is mounted inside the handle and coupled to the first and second arms and the handle. The movement control mechanism is configured to ensure that the two end connection sections move toward and away from the body in unison to inhibit angular movement of the grip portion relative to the body. A damping element disposed between the handle and the body to reduce vibration transferred from the body to the rear handle.

Implementations of this aspect may include one or more of the following features. The movement control mechanism may include an axle extending between the first and second end connection sections of the handle and pivotally mounted about its longitudinal axis inside of the handle. The axle may be mounted to the handle so that a distance between the longitudinal axis of the axle and the body remains constant when the handle moves relative to the body. The movement control mechanism may include a connector rigidly connected to the axle, the connector being pivotally coupled to the handle about a pivot axis so that the pivot axis moves relative to the body when the handle moves relative to the body. The pivot axis may be substantially parallel to the longitudinal axis. The connector may include a bent portion of the axle. The connector may be pivotally coupled to the handle to enable movement of the connector relative to the handle in a side-to-side direction that is substantially perpendicular to both the tool axis and the longitudinal axis. The axle may be mounted to the handle so that the longitudinal axis of the axle moves relative to the body when the handle moves relative to the body. The movement control mechanism may include a connector rigidly connected to the axle, the connector being pivotally coupled to the handle about a pivot axis so that the pivot axis remains stationary relative to the body when the handle moves relative to the body. The pivot axis may be substantially parallel to the longitudinal axis. The connector may include a peg that is connected to the axle by a lever.

The movement control mechanism may include first and second C-shaped members fixedly coupled to the first and second arms, wherein the axle is mounted to be pivotable relative to the axle. The first and second C-shaped members may include C-shaped hooks that face in opposite directions and that pivotally receive axle. The first and second C-shaped members may receive pegs that are fixedly coupled to the axle to enable side-to-side movement of the pegs. The movement control mechanism may include a pair of connectors fixedly connected to each end of the axle, the connectors defining pivot axes about which the connectors pivot, the pivot axes being substantially parallel to the longitudinal axis. The connectors may be coupled to the handle via bearings. The pivot axes of the connectors may be co-axial. The dampening mechanism may include a helical spring.

In another aspect, a vibration damping handle is configured to be coupled to a rear end portion of a body of a powered hammer having a tool axis defined by a tool holder and first and second arms that project from the body. The vibration damping handle includes a handle including a grip portion and first and second end connection sections coupled to opposite end portions of the grip portion. The first and second end connection sections are slideably mounted on the first and second arms to enable sliding movement of the handle toward and away from the body along the tool axis. A damping element is disposed between the handle and the body to reduce vibration transferred from the body to the rear handle. First and second bearings fixedly coupled to the first and second arms and extending inside of the handle. Third and fourth bearings are fixedly coupled to the handle and extending inside of the handle. An axle is disposed inside the handle, extending between the first and second end connection sections in a direction substantially perpendicular to the tool axis, and pivotally mounted with respect to the first and second bearings to enable the axle to rotate about a longitudinal axis of the axle. First and second connectors are disposed inside the handle, fixedly coupled to the axle, and extending along a pivot axis that is substantially parallel to the longitudinal axis. The first and second connectors are pivotally mounted with respect to the third and fourth bearings. The third and fourth bearings are configured to enable side-to-side movement of the connectors in a direction that is perpendicular to the longitudinal axis and the tool axis. When the handle moves relative to the body along the tool axis, the axle rotates about the longitudinal axis, which remains stationary relative to the body, and the first and second connectors rotate about the pivot axis, which moves relative to the body, inhibiting angular movement of the handle relative to the body.

In another aspect, a vibration damping handle is configured to be coupled to a rear end portion of a body of a powered hammer having a tool axis defined by a tool holder and first and second arms that project from the body. The vibration damping handle includes a handle including a grip portion and first and second end connection sections coupled to opposite end portions of the grip portion. The first and second end connection sections are slideably mounted on the first and second arms to enable sliding movement of the handle toward and away from the body along the tool axis. A damping element is disposed between the handle and the body to reduce vibration transferred from the body to the rear handle. First and second bearings are fixedly coupled to the first and second arms and extending inside of the handle. Third and fourth bearings fixedly coupled to the handle and extending inside of the handle. An axle is disposed inside the handle, extending between the first and second end connection sections in a direction substantially perpendicular to the tool axis, and pivotally mounted with respect to the third and fourth bearings to enable the axle to rotate about a longitudinal axis of the axle. First and second connectors are disposed inside the handle, fixedly coupled to the axle, and extending along a pivot axis that is substantially parallel to the longitudinal axis. The first and second connectors are pivotally mounted with respect to the first and second bearings. The first and second bearings are configured to enable side-to-side movement of the connectors in a direction that is perpendicular to the longitudinal axis and the tool axis. When the handle moves relative to the body along the tool axis, the first and second connectors rotate about the pivot axis, which remains stationary relative to the body, and the axle rotates about the longitudinal axis, which moves relative to the body, inhibiting angular movement of the handle relative to the body.

Advantages may include one or more of the following. The movement control mechanism enables the handle to relative to the body along the tool axis along the first and second arm, while inhibiting angular movement of the handle relative to the body. The movement control mechanism is located within the handle, as opposed to the body, freeing up valuable space in the body. These and other advantages and features will be apparent from the description, the drawings, and the claims.

DETAILED DESCRIPTION

Figure 1:
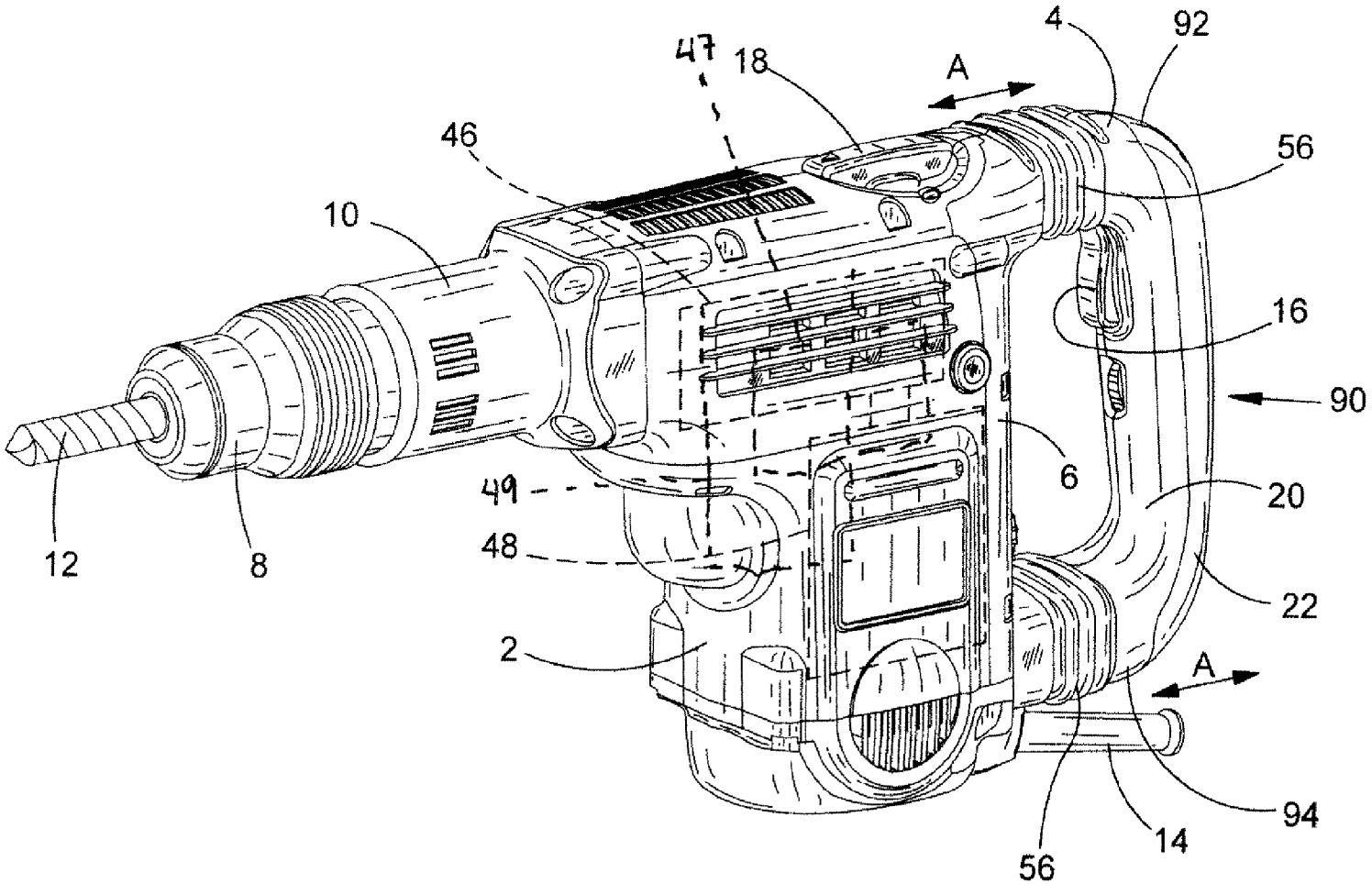
FIG. 1 shows a sketch of a side view of a powered hammer.

A first embodiment will now be described with reference to FIGS. 1 to 3. Referring to FIG. 1, a powered hammer, e.g., a hammer drill, comprises a body 2 having a rear handle 4 moveably mounted to the rear 6 of the body 2. The rear handle 4 includes a centre grip section 90 and two end connection sections 92, 94, with one end connection section 92 being attached to one end of the centre grip section, and the other end connection section 94 being connected to the other end of the centre grip section. The handle is connected to the body of the two end connection sections 92, 94.

A tool holder 8 is mounted onto the front 10 of the body 2. The tool holder can hold a cutting tool 12, such as a drill bit or a hammer bit. A motor (shown generally by dashed lines 48) is mounted within the body 2 which is powered, e.g., by a mains electricity supply via a cable 14. A trigger switch 16 is mounted on the rear handle 4. Depression of the trigger switch 16 activates the motor. The body 2 includes a hammer mechanism (shown generally by dashed lines 46) driven by the motor 48. The hammer mechanism 46 includes, e.g., a ram (not shown) that reciprocates within a cylinder (not shown), and which strikes a beat piece (not shown), which in turn strikes an end of the cutting tool 12. In addition, or alternatively, the body includes a drilling mechanism (shown generally by dashed lines 49) driven by the motor to rotationally drive the tool holder 8 via a series of gears (not shown). The body 2 also includes a mode change mechanism (shown generally by dashed lines 47) that can switch the hammer drill between one or more of three modes of operation, namely hammer only mode, drill only mode or hammer and drill mode. A rotatable knob 18 is mounted on the top of the body 2. Rotation of the knob 18 changes the mode of operation of the hammer drill in well known manner. EP1157788, which is incorporated herein by reference in its entirety, discloses possible embodiments of a hammer mechanism, a drilling mechanism, and a mode change mechanism.

The rear 6 of the body is formed, e.g., by a plastic clam shell which attaches to the remainder of the body 2 using screws (not shown). The rear handle 4 can move in the direction of Arrow A in FIG. 1. The movement of handle 4 is controlled, as described below, so that the handle 4 moves substantially linearly towards or away from the body 2 of the hammer drill, but is inhibited from rotation relative to the body 2 of the hammer drill. The rear handle comprises a handle body 20 and a rear cover 22 which is attached to the handle body using screws. A hole is formed through the handle body 20 through which the trigger switch 16 projects.

Figure 2:
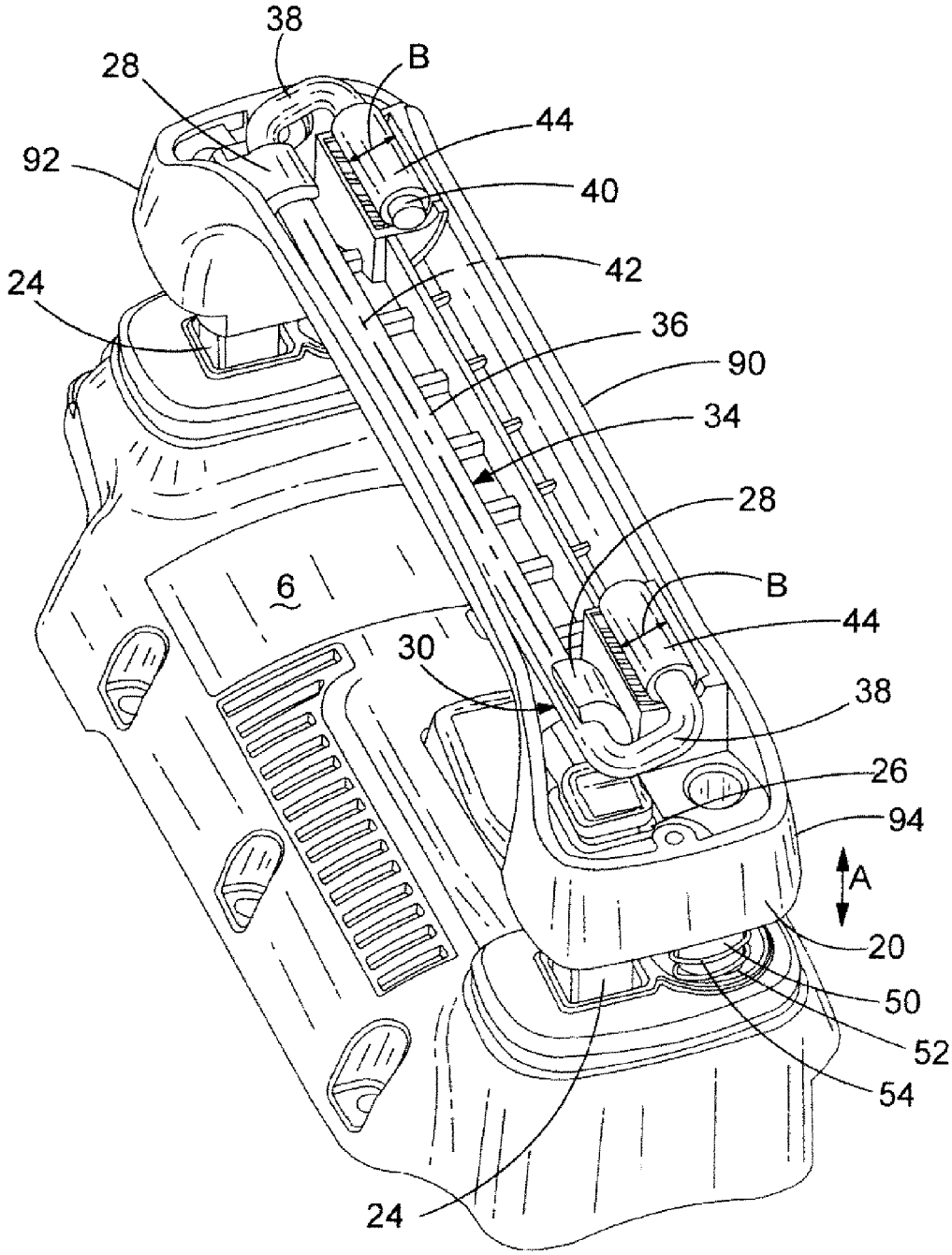
FIG. 2 shows a sketch of one embodiment of the rear handle assembly, with the rear cover removed when located at its furthermost position from the body.
Figure 3:
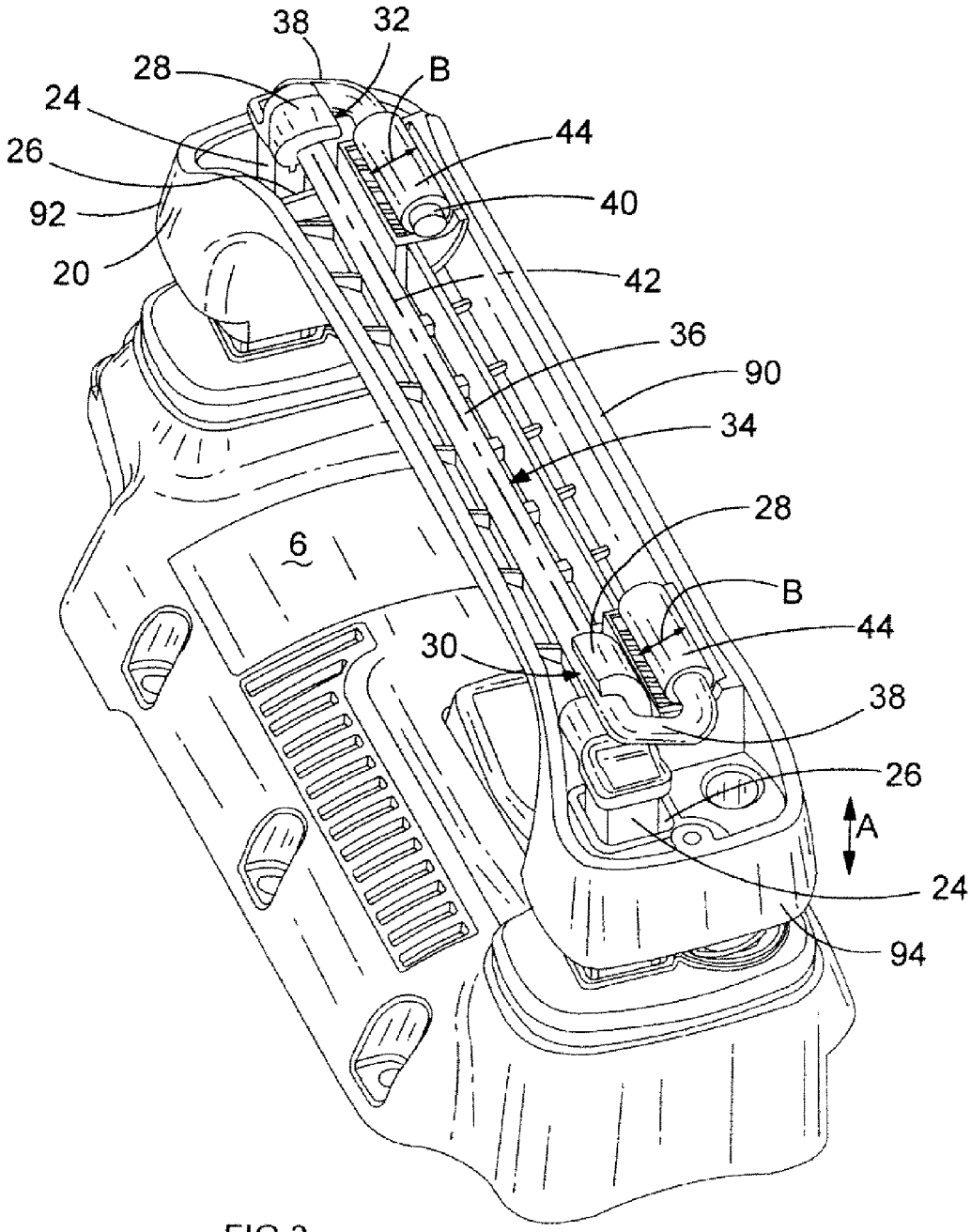
FIG. 3 shows a sketch of embodiment of the rear handle assembly of FIG. 2, with the rear cover removed when located at its nearest position to the body.

Referring also to FIGS. 2 and 3, rigidly attached to the rear 6 of the body 2 are two arms, e.g., rods 24 of square cross section, which extend in the direction of Arrow A, substantially in parallel to each other. The two rods pass through apertures, e.g., square apertures 26, formed in the handle body 20 of the rear handle 4. The dimensions of the square cross section of the two rods 24 are slightly less than the square apertures 26 in the handle body 20 to allow relative movement between the rods 24 and the apertures 26 while preventing too much play. As the handle 4 moves towards or away from the body 2, the handle body 20 slides along the lengths of the two rods 24.

Attached to the ends of each of the rods 24 is a C-shaped hook 28. An open side 30 of one C-shaped hook 28 faces in the opposite direction to an open side 32 of the other C-shaped hook 28. The position of the C-shaped hooks 28 remains stationary relative to the body 2 when the handle 4 moves towards or away from the body 2.

Disposed in the handle 4 is an axle formed by a wire rod 34. The wire rod 34 is bent at either end so that the wire rod 34 includes a long central section 36, two perpendicular end sections 38 at either end of the central section 36, and two terminal sections 40 coupled to the end sections 38. The two end sections 38 each are bent to be substantially perpendicular to the central section 36 and parallel to each other. The two terminal sections 40 are bent further to be substantially aligned with each other and substantially parallel with the central section 36. The central section 36 defines a longitudinal axis 42. Portions of the central section 36 adjacent the end sections 38 are located within the two C-shaped hooks 28, such that, when the handle 4 moves relative to the body 2, the position of the longitudinal axis 42 remains stationary relative to the C-shaped hooks, but the central section 36 is allowed to rotate about its longitudinal axis 42 within the C-shaped hooks 28.

Each of the two terminal sections 40 is rotatably mounted within a bearing, e.g., tubular bearings 44. The two tubular bearings 44 are mounted within the handle 4 by being sandwiched between the handle body 20 and the rear cover 22 to prevent movement of the tubular bearings 44 within the handle 4 in either a backwards or rearwards direction (Arrow A). However, the handle body 20 and rear cover 22 are designed to allow a limited sideways movement of the tubular bearings 44 (Arrow B) to accommodate the pivotal movement of the bearings 44 around the longitudinal axis 42 of the central section 36. As such, movement of the handle 2 towards or away from the body results in the movement of the tubular bearings 44 towards or away from the body 2 with the handle 4. The two terminal sections 40 can freely rotate within the tubular bearings 44.

Rigidly attached to the underside of the handle body 20 at each end are two additional guide rods 50, of e.g., circular cross section, which extend in the direction of Arrow A, in parallel to each other. The two rods pass through apertures 52 formed in the rear 6 of the body 2. The dimensions of the cross section of the two guide rods 50 are slightly less than the apertures in the body 2 to allow relative movement between the two while preventing too much play. As the handle 4 moves towards or away from the body 2, the rear 6 of the body 2 slides along the lengths of the two guide rods 50. A helical spring 54 is wrapped around one of the guide rods 50 and is sandwiched between the rear 6 of the body 2 and the handle body 2 under compression force. The spring biases the handle 4 away from the body 2 and damps vibration between the handle and the body. A rubber bellows 56 surrounds each pair of rods 24 and 50.

In operation, the handle 4 is initially biased away from the body 2 by the spring 54. The two C-shaped hooks 28 limit the maximum amount of travel of the handle 4 away from the body 2 as they are too large to pass through the square apertures 26. The operator activates the hammer and pushes the cutting tool 12 against a work piece by pushing the rear handle 4 towards the body 2. When the operator applies a force onto the handle 4, the handle 4 moves towards the body 2 against the biasing force of the spring 54, as the body is prevented from movement by the action of the cutting tool 12 on the work piece. As the handle 4 moves towards the body 2, the handle body 20 slides along the two rods 24 of square cross section. The wire rod 34 ensures that the handle slides along the two rods in unison thus preventing the handle from twisting relative to the body 2.

While the handle is sliding along the rod, the position of central section 36 of the wire rod 34 is held stationary relative to the body 2. However, the two tubular bearings 44 and hence the terminal sections 40 of the wire rod move with the handle towards the body. As such, the central section 36 of the wire rod 34 rotates about its longitudinal axis 42. This causes the terminal sections 40 of the wire rod and hence the tubular bearings to rotate about the longitudinal axis of the central section at the same rate. Thus the amount of movement of the two connection ends 92; 94 of the handle are substantially equal and thus move substantially in unity. If the operator tries to move one end whilst the other is being prevented, it will be blocked as the bent wire rod is prevented from twisting.

Figure 4:
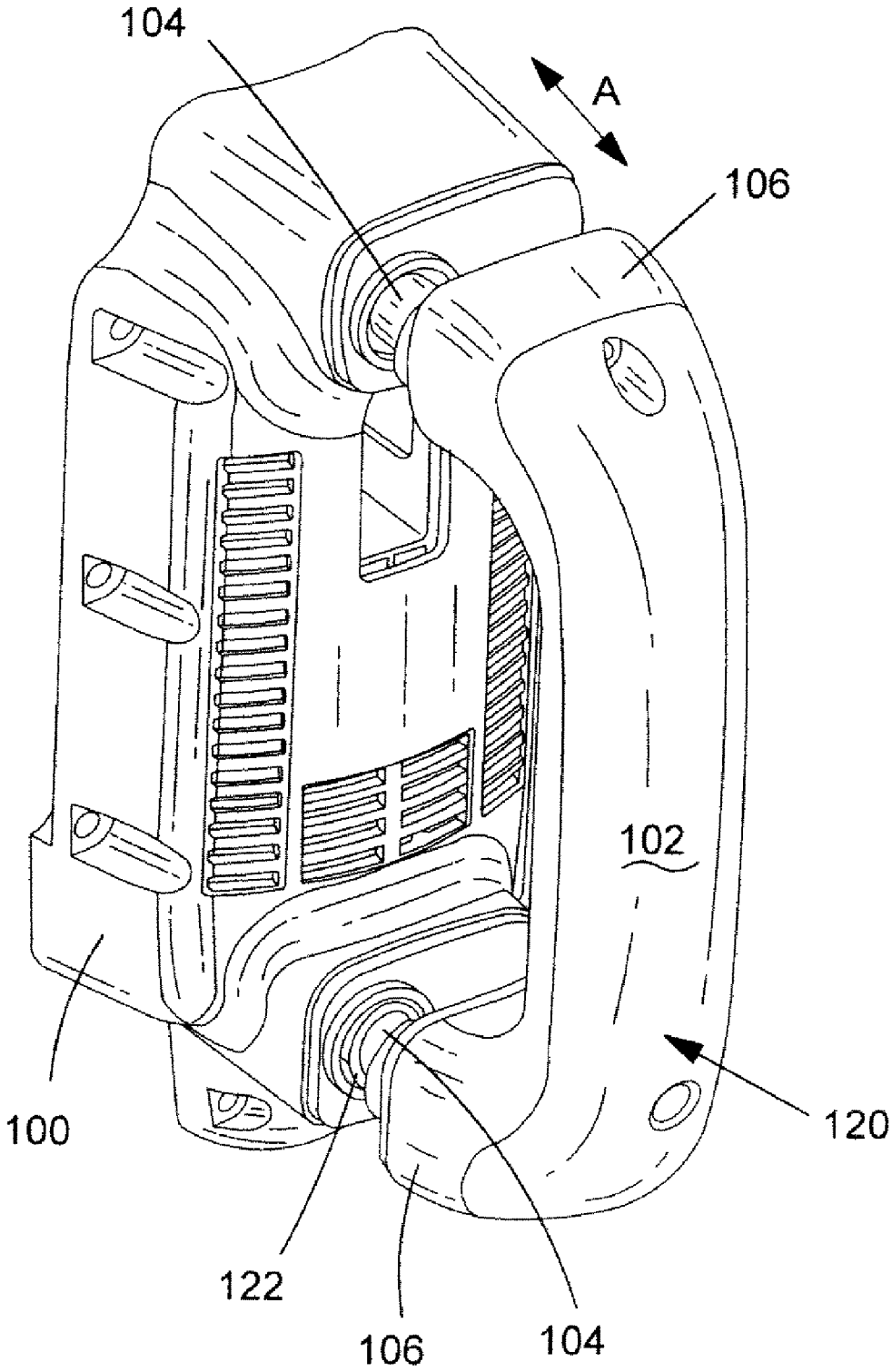
FIG. 4 shows a handle incorporating a second embodiment of the rear handle assembly.
Figure 5:
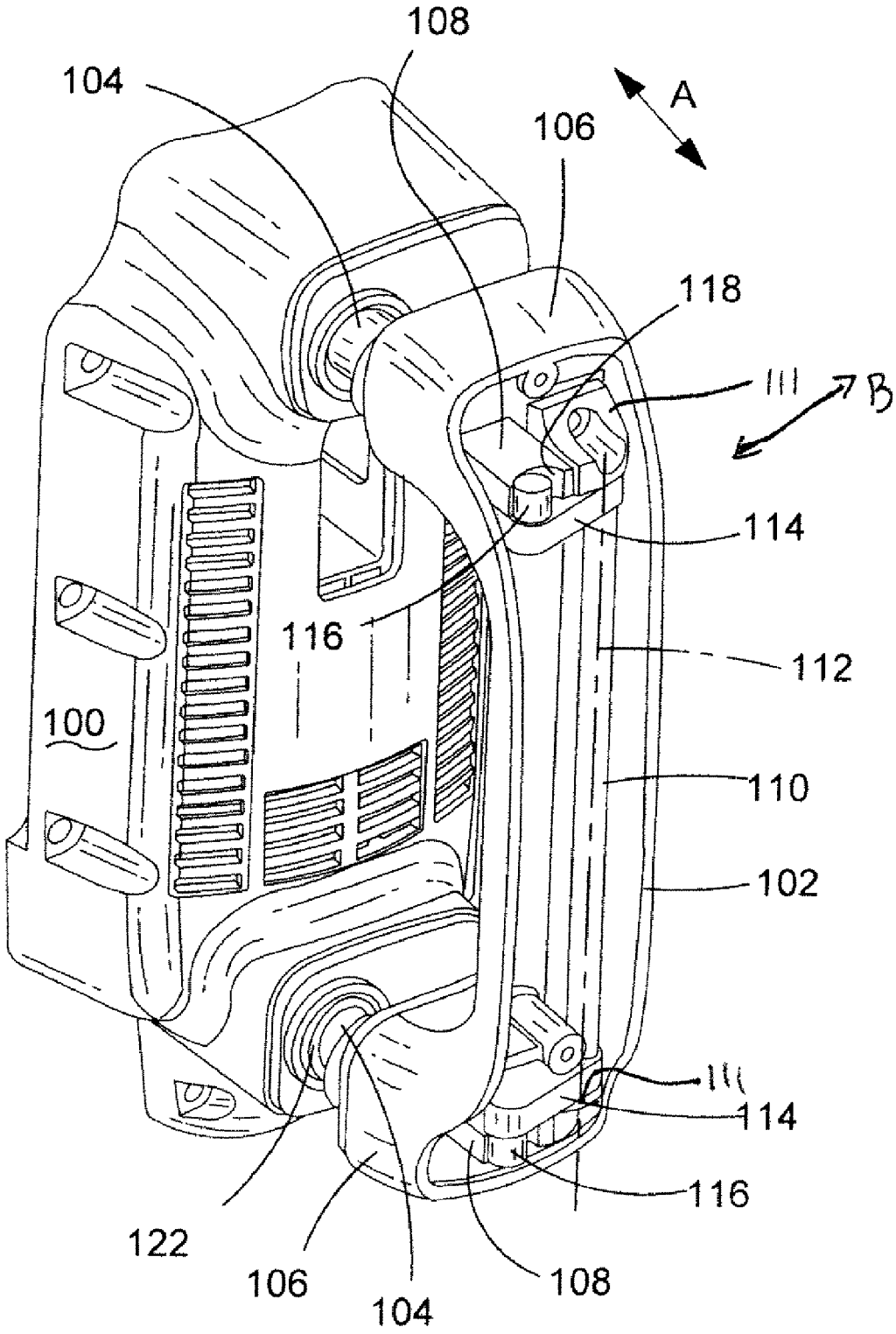
FIG. 5 shows the second embodiment of the rear handle assembly of FIG. 4, with the rear cover removed when located at its furthermost position from the body.
Figure 6:
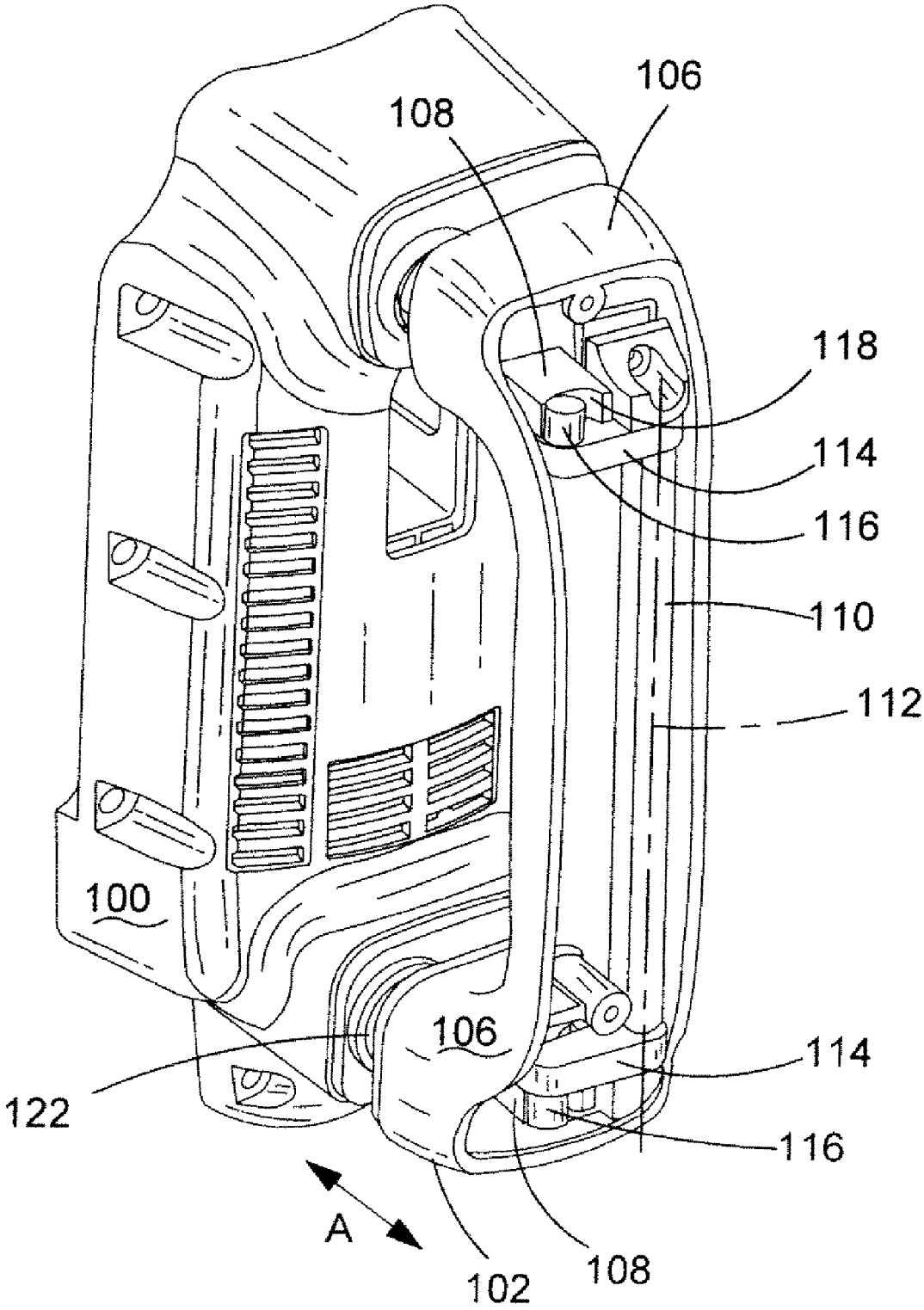
FIG. 6 shows the second embodiment of the rear handle assembly of FIG. 4, with the rear cover removed when located at its nearest position to the body.

A second embodiment will now be described with reference to FIG. 4 to 6. Mounted on a rear 100 of the body of a hammer drill (similar to the hammer drill of FIG. 1) is a handle 102 which is capable of moving linearly, in a direction of arrow A, substantially parallel to a longitudinal axis of the hammer drill. Projecting from the rear 100 of the body of the hammer drill are two horizontal arms 104. The ends 106 of the handle 102 are slideably mounted on to the two arms 104 such that the handle can slide along the length of the two arms 104, the ends 108 of the two arms 104 extending into the handle 102.

Rotatably mounted within the handle 102 is an axle defined by a vertical rod 110. The vertical rod 110 is capable of freely rotating about its longitudinal axis 112. The vertical rod 110 is coupled to the handle 102 by bearings 111 so that movement of the handle 102 towards or away from the body of the hammer drill results in the vertical rod 110 moving towards or away from the body in a corresponding manner, the longitudinal axis 112 of the vertical rod 110 remaining stationary relative to the handle. Fixedly attached to the two ends of the vertical rod 110 are two levers 114 which extend substantially perpendicularly to the longitudinal axis of the vertical rod 111 and parallel to each other and which rotate together with the vertical rod 110.

Projecting from each of the two levers 114 are pegs 116. The pegs 116 engage with semi-circular recesses 118 formed in ends 108 of the two arms 104 which extend from the rear 100 of the body of the hammer drill. Each of the pegs 116 are held in the circular recesses 118 in engagement with the ends of the two horizontal arms 104 by a clip (not shown). The circular recesses and clips are arranged so that they allow a small amount of sideways movement of the pegs 116 (along arrow B) within the circular recesses to accommodate the rotary movement of the pegs 116 about the longitudinal axis of the vertical rod when the handle and vertical rod is moved towards and way from the rear of the body.

A spring 122 is located between the lower end 106 of the handle and the rear 100 of the body to bias the handle rearward. The movement of the handle 102 is controlled by the sliding motion of the handle 102 along the two arms 104. As the handle slides, the pegs 116 remain stationary relative to the rear of the body due to their contact with the ends of the arms 114. However, the vertical rod moves with the handle. This results in rotation of the rod about its longitudinal axis. However, as the levers are rigidly connect to the vertical rod they must rotate at the same rate, resulting in the rate of movement of the arms into the handle being uniform. As such, the top and bottom of the handle slide along the arms in a substantially uniform manner, inhibiting a twisting motion of the handle relative to the rear of the body. The vertical rod 110, together with the horizontal levers 114 and their engagement with the two arms 104, ensure that the movement of the handle 102 on the arms is linear, with substantially no twisting movement of the handle relative to the body of the hammer drill occurring. The spring 122 acts as a dampener to reduce the amount of vibration transferred between the body and the handle 102.

Numerous modifications may be made to the exemplary implementations described above. For example, in either embodiment, the handle could be used with a power tool other than a hammer drill, or with a powered hammer drill or hammer that has only one or more of the three modes of operation of the disclosed embodiment of FIG. 1. In either embodiment, the hammer drill could be powered by an alternative power source such as a battery or compressed air. In either embodiment, there could be more than one spring disposed between the handle and the body, for example on the rod that does not have a spring as shown in the drawings. In the first embodiment, the rods that extend from the body in the first embodiment could have a different shape, such as circular or rectangular. In the first embodiment, the guide rods 50 could be eliminated and the spring could be disposed around one of the rods 24. In the first embodiment, the C-shaped hooks in the first embodiment could face the same direction, and the bearings could have a different configuration. In the second embodiment, the vertical rod, levers, and/or pegs could be replaced with a single unitary rod bent with the desired shape. The second embodiment could include a second pair of guide rods, like the guide rods 50 in the first embodiment, with a spring disposed about the one of the second pair of guide rods. These and other implementations are within the scope of the following claims.

What is claimed is:

1. A powered hammer comprising:

a body in which is disposed a motor and a hammer mechanism driven by the motor when the motor is activated;

a tool holder coupled to a front portion of the body and which is capable of holding a cutting tool, the hammer mechanism, when driven by the motor, capable of imparting impacts to a cutting tool, when held by the tool holder;

a handle moveably coupled to a rear portion of the body for movement toward and away from the body along a tool axis of the toot holder, the handle including a grip portion and first and second end connection sections coupled to opposite end portions of the grip portion, the first and second end connection sections slideably mounted on first and second arms that project rearward from the body;

a movement control mechanism mounted inside the handle and coupled to the first and second arms and the handle, the movement control mechanism configured to ensure that the two end connection sections move toward and away from the body in unison to inhibit angular movement of the grip portion relative to the body; and a damping element disposed between the handle and the body to reduce vibration transferred from the body to the rear handle;

wherein the movement control mechanism comprises an axle extending between the first and second end connection sections of the handle and pivotally mounted about its longitudinal axis inside of the handle.

2. The powered hammer of claim 1, wherein the axle is mounted to the handle so that a distance between the longitudinal axis of the axle and the body remains constant when the handle moves relative to the body.

3. The powered hammer of claim 2, wherein the movement control mechanism further comprises a connector rigidly connected to the axle, the connector being pivotally coupled to the handle about a pivot axis so that the pivot axis moves relative to the body when the handle moves relative to the body.

4. The powered hammer of claim 3, wherein the pivot axis is substantially parallel to the longitudinal axis.

5. The powered hammer of claim 4, wherein the connector comprises a bent portion of the axle.

6. The powered hammer of claim 4, wherein the connector is pivotally coupled to the handle to enable movement of the connector relative to the handle in a side-to-side direction that is substantially perpendicular to both the tool axis and the longitudinal axis.

7. The powered hammer of claim 1, wherein the axle is mounted to the handle so that the longitudinal axis of the axle moves relative to the body when the handle moves relative to the body.

8. The powered hammer of claim 7 wherein the movement control mechanism comprises a connector rigidly connected to the axle, the connector being pivotally coupled to the handle about a pivot axis so that the pivot axis remains stationary relative to the body when the handle moves relative to the body.

9. The powered hammer of claim 8, wherein the pivot axis is substantially parallel to the longitudinal axis.

10. The powered hammer of claim 9, wherein the connector comprises a peg that is connected to the axle by a lever.

11. The powered hammer of claim 1, wherein the movement control mechanism further comprises first and second C-shaped members fixedly coupled to the first and second arms, wherein the axle is mounted to be pivotable relative to the axle.

12. The powered hammer of claim 11, wherein the first and second C-shaped members comprise C-shaped hooks that face in opposite directions and that pivotally receive axle.

13. The powered hammer of claim 11, wherein the first and second C-shaped members receive pegs that are fixedly coupled to the axle to enable side-to-side movement of the pegs.

14. The powered hammer of claim 1, wherein the movement control mechanism further comprises a pair of connectors fixedly connected to each end of the axle, the connectors defining pivot axes about which the connectors pivot, the pivot axes being substantially parallel to the longitudinal axis.

15. The powered hammer of claim 14, wherein the connectors are coupled to the handle via bearings.

16. The powered hammer of claim 14, wherein the pivot axes of the connectors are co-axial.

17. The powered hammer of claim 1, wherein the dampening mechanism comprises a helical spring.

18. A vibration damping handle configured to be coupled to a rear end portion of a body of a powered hammer having a tool axis defined by a tool holder and first and second arms that project from the body, the vibration damping handle comprising:

a handle including a grip portion and first and second end connection sections coupled to opposite end portions of the grip portion, the first and second end connection sections slideably mounted on the first and second arms to enable sliding movement of the handle toward and away from the body along the tool axis;

a damping element disposed between the handle and the body to reduce vibration transferred from the body to the rear handle;

first and second bearings fixedly coupled to the first and second arms and extending inside of the handle;

third and fourth bearings fixedly coupled to the handle and extending inside of the handle; an axle disposed inside the handle, extending between the first and second end connection sections in a direction substantially perpendicular to the tool axis, and pivotally mounted with respect to the first and second bearings to enable the axle to rotate about a longitudinal axis of the axle; and first and second connectors disposed inside the handle, fixedly coupled to the axle, and extending along a pivot axis that is substantially parallel to the longitudinal axis, the first and second connectors pivotally mounted with respect to the third and fourth bearings, the third and fourth bearings configured to enable side-to-side movement of the connectors in a direction that is perpendicular to the longitudinal axis and the tool axis, wherein, when the handle moves relative to the body along the tool axis, the axle rotates about the longitudinal axis, which remains stationary relative to the body, and the first and second connectors rotate about the pivot axis, which moves relative to the body, inhibiting angular movement of the handle relative to the body.

19. A vibration damping handle configured to be coupled to a rear end portion of a body of a powered hammer having a tool axis defined by a tool holder and first and second arms that project from the body, the vibration damping handle comprising:

a handle including a grip portion and first and second end connection sections coupled to opposite end portions of the grip portion, the first and second end connection sections slideably mounted on the first and second arms to enable sliding movement of the handle toward and away from the body along the tool axis;

a damping element disposed between the handle and the body to reduce vibration transferred from the body to the rear handle;

first and second bearings fixedly coupled to the first and second arms and extending inside of the handle;

third and fourth bearings fixedly coupled to the handle and extending inside of the handle;

an axle disposed inside the handle, extending between the first and second end connection sections in a direction substantially perpendicular to the tool axis, and pivotally mounted with respect to the third and fourth bearings to enable the axle to rotate about a longitudinal axis of the axle; and first and second connectors disposed inside the handle, fixedly coupled to the axle, and extending along a pivot axis that is substantially parallel to the longitudinal axis, the first and second connectors pivotally mounted with respect to the first and second bearings, the first and second bearings configured to enable side-to-side movement of the connectors in a direction that is perpendicular to the longitudinal axis and the tool axis, wherein, when the handle moves relative to the body along the tool axis, the first and second connectors rotate about the pivot axis, which remains stationary relative to the body, and the axle rotates about the longitudinal axis, which moves relative to the body, inhibiting angular movement of the handle relative to the body.

* * * * *